US008087474B2

(12) United States Patent
Shinma et al.

(10) Patent No.: US 8,087,474 B2
(45) Date of Patent: Jan. 3, 2012

(54) HAMMER DRILL

(75) Inventors: Yasutoshi Shinma, Anjo (JP); Keiji Nakashima, Anjo (JP); Hajime Takeuchi, Anjo (JP)

(73) Assignee: Makita Corporation, Anjo (JP)

( * ) Notice: Subject to any disclaimer, the term of this patent is extended or adjusted under 35 U.S.C. 154(b) by 321 days.

(21) Appl. No.: 12/450,615

(22) PCT Filed: Feb. 22, 2008

(86) PCT No.: PCT/JP2008/053080

§ 371 (c)(1),
(2), (4) Date: Oct. 2, 2009

(87) PCT Pub. No.: WO2008/132866

PCT Pub. Date: Nov. 6, 2008

(65) Prior Publication Data

US 2010/0096154 A1 Apr. 22, 2010

(30) Foreign Application Priority Data

Apr. 12, 2007 (JP) ..... 2007-105238

(51) Int. Cl.
*B25D 11/04* (2006.01)
*B25D 16/00* (2006.01)

(52) U.S. Cl. ..... 173/48; 173/109; 173/178; 173/201

(58) Field of Classification Search ..... 173/48, 173/109, 201, 176, 178, 114
See application file for complete search history.

(56) References Cited

U.S. PATENT DOCUMENTS

| | | | | |
|---|---|---|---|---|
| 4,446,931 | A * | 5/1984 | Bleicher et al. | 173/48 |
| 5,320,177 | A * | 6/1994 | Shibata et al. | 173/48 |
| 5,842,527 | A | 12/1998 | Arakawa et al. | |
| 6,478,095 | B2 * | 11/2002 | Neumaier | 173/48 |
| 6,725,944 | B2 * | 4/2004 | Burger et al. | 173/48 |
| 7,306,049 | B2 * | 12/2007 | Soika et al. | 173/49 |
| 7,325,624 | B2 * | 2/2008 | Yamazaki | 173/48 |
| 7,383,895 | B2 | 6/2008 | Aoki | |
| 7,395,872 | B2 * | 7/2008 | Duesselberg et al. | 173/48 |

(Continued)

FOREIGN PATENT DOCUMENTS

CN 1373022 A 10/2002

(Continued)

OTHER PUBLICATIONS

Jun. 10, 2008 Search Report Issued in the International Application No. PCT/JP2008/053080 (with translation).

(Continued)

*Primary Examiner* — Scott A. Smith
(74) *Attorney, Agent, or Firm* — Oliff & Berridge, PLC

(57) ABSTRACT

A hammer drill having a clutch pin and a clutch mechanism is provided. By switching the clutch mechanism, a selection can be made between a hammer drill mode and a hammer mode. The clutch pin is configured to be slidable to a sliding position where the clutch pin runs through the reduction shaft so as to be capable of protruding beyond the reduction shaft, and at the sliding position, the clutch pin engages with an engagement hole provided on the tool holder side so that a rotation of the tool holder can be locked, whereby in the hammer mode, a selection can be further made between a neutral state where the clutch pin does not engage with the engagement hole and a rotation locked state where the clutch pin engages with the engagement hole.

15 Claims, 4 Drawing Sheets

U.S. PATENT DOCUMENTS

| | | | | |
|---|---|---|---|---|
| 7,588,097 | B2 * | 9/2009 | Kamegai et al. | 173/162.1 |
| 2007/0039749 | A1 | 2/2007 | Aoki | |

FOREIGN PATENT DOCUMENTS

| | | | |
|---|---|---|---|
| CN | 1915606 | A | 2/2007 |
| JP | U-7-37580 | | 7/1995 |
| JP | A-9-57650 | | 3/1997 |
| JP | A-2002-254224 | | 9/2002 |

OTHER PUBLICATIONS

Chinese Office Action issued in Chinese Patent Application No. 200880011716.4 dated Mar. 15, 2011 (with translation).

* cited by examiner (A)

(B)

HAMMER DRILL

TECHNICAL FIELD

This invention relates to a hammer drill which can impart an impact and a rotation simultaneously to a bit installed at a front end of the hammer drill.

BACKGROUND ART

As a hammer drill, for example, an apparatus such as disclosed in Patent Document 1 is known. In this apparatus, a tool spindle (tool holder) having a bit-installable front end is rotatably supported in a housing, and a motor is disposed in the housing with an output shaft thereof oriented in a direction perpendicular to an axis of the tool holder. Further, in the housing, an impact mechanism is provided which comprises a piston configured to make a reciprocating motion by means of a crank mechanism actuated according to a rotation of the output shaft and an impactor configured to move in synchronization with the piston by the action of an air spring. With this configuration, upon activation of the motor, the piston is caused to reciprocate by means of the crank mechanism, and the impactor synchronized with the piston strikes a bit directly or indirectly through an interjacent element such as an impact bolt.

Meanwhile, a shaft (speed reduction shaft) provided with a bevel gear and being in mesh with a bevel gear on the tool holder side is rotatably supported in a position parallel to the output shaft between the tool holder and the output shaft of the motor, two gears meshed with another shaft provided closer to the motor are rotatably fitted onto the shaft, and a connecting slider (clutch pin) is provided at a shaft center of the shaft so as to be slidable along an axial direction of the shaft and projections thereof are configured to be engaged with or disengaged from the gear and the shaft in accordance with sliding positions of the connecting slider, so that a clutch mechanism configured to permit switching of operation modes is provided. To be more specific, when the projections of the connecting slider are engaged with the gear, the gear operates integrally with the shaft to transmit a rotary motion of the output shaft to the shaft, so that the tool holder is rotated through the bevel gear. This mode of operation is called as a hammer drill mode. On the contrary, when the projections of the connecting slider are engaged with the housing side, the transmission of the rotary motion from the gear to the shaft is interrupted so that a striking motion only is generated, and a rotary motion of the shaft is restricted to lock the rotation of the tool holder. This mode of operation is called as a hammer mode.

In a state where the projections of the connecting slider are free from engagement with both the gear and the housing, the transmission of the rotary motion from the gear to the shaft is interrupted so that a striking motion only is generated, and the shaft is allowed to rotate freely so that the tool holder becomes freely rotatable. This mode of operation is called as a neutral mode.

Patent Document 1: Japanese Laid-open Patent Publication No. 2002-28878

DISCLOSURE OF INVENTION

Problems to be Solved by the Invention

In the aforementioned conventional hammer drill, since the projections of the connecting slider is caused to engage with or disengage from the gear or the housing side, the projections are subject to a large load, which may lead to wear or breakage. Therefore, there is a problem in durability. Further, in the hammer drill mode, since the connecting slider rotates together with the shaft, the connecting slider may also have the same problem such as wear or breakage, which will result in deteriorated durability of the connecting slider. Furthermore, the connecting slider is required to have sliding positions; where the connecting slider engages with the gear, where the connecting slider engages with the housing, and where the connecting slider does not engage with any of the gear or the housing. This will lead to an enlarged size of the shaft or the connecting slider in its axial direction in order to secure a stroke length for the connecting slider, which adversely affects on reduction in the size.

In view of the above, it is an object of the present invention to provide a hammer drill in which, even if such a clutch pin is employed, mode switching can be reliably performed with a durable and small-sized configuration.

Means for Solving the Problems

In order to achieve the above object, the invention as set forth in claim 1 provides that a clutch pin is provided in a reduction shaft so as to be slidable along an axis of the reduction shaft, the clutch pin being configured to be slidable by an operation from outside a housing, that a driven gear is inserted onto the reduction shaft and configured to be rotatable separately from the reduction shaft, that a clutch mechanism is provided such that the engagement between the driven gear and the reduction shaft and the disengagement between the driven gear and the reduction shaft are switchable in accordance with sliding positions of the clutch pin, and that by switching the clutch mechanism, a selection can be made between a hammer drill mode where the driven gear is caused to engage with the reduction shaft so that a rotary motion is transmitted to a tool holder and a hammer mode where the driven gear and the reduction gear are disengaged from each other so that the rotary motion transmitted to the tool holder is interrupted, wherein the clutch pin is configured to be slidable to a sliding position where the clutch pin runs through the reduction shaft so as to be capable of protruding upward beyond the reduction shaft, and at the sliding position, the clutch pin engages with an engagement portion provided on the tool holder side so that a rotation of the tool holder can be locked, whereby in the hammer mode, a selection can be further made between a neutral state where the clutch pin does not engage with the engagement portion to allow free rotation of the tool holder and a rotation locked state where the clutch pin engages with the engagement portion to lock the rotation of the tool holder.

In order to simplify the configuration of the clutch mechanism, the invention as set forth in claim 2 provides that the clutch mechanism comprises at least one ball provided in the reduction shaft so as to be movable in a radial direction of the reduction shaft, and a pressing portion provided at the clutch pin, the pressing portion pressing the ball toward outside of the reduction shaft so that the ball is interposed between the reduction shaft and the driven gear so as to engage the reduction shaft and the driven gear when the clutch pin is positioned in a sliding position in the hammer drill mode, and the pressing portion releasing a pressing motion of the ball to disengage the engagement between the driven gear and the reduction shaft when the clutch pin is positioned in other sliding positions in the other mode.

The invention as set forth in claim 6 provides that the clutch pin is configured to be slidable to a sliding position where the clutch pin runs through the reduction shaft so as to be capable of protruding downward beyond the reduction shaft, and an urging member for urging the clutch pin toward the protruding direction is provided, and that a rocking member to which the clutch pin at the protruding position contacts is provided in the housing at a position below the clutch pin, and the rocking member is connected by wire to an operating member provided at an external surface of the housing, so that the sliding positions of the clutch pin can be changed when the rocking member is rocked through the wire by an operation of the operating member.

Advantageous Effects of the Invention

According to the invention as set forth in claim 1, in the hammer mode, an upper end of the clutch pin is directly engaged with or disengaged from the tool holder side without rotating the clutch pin so that the neutral state and the rotation locked state can be selected. Therefore, the clutch pin is less likely to subject to wear or breakage, so that better durability is achieved. Further, the mode switching is performed by sliding the clutch pin in a relatively short stroke length, so that the whole size of the hammer drill as well as the size of the reduction shaft can be reduced.

According to the invention as set forth in claim 2, a highly durable and simple clutch mechanism utilizing the clutch pin can be provided by the use of the ball.

According to the invention as set forth in claim 6, the rocking operation of the rocking member is simply and reliably performed by the use of the wire.

BEST MODE FOR CARRYING OUT THE INVENTION

Embodiments of the present invention will be described hereinafter with reference to the accompanying drawings.

In FIG. 1, which shows a partial vertical section of a hammer drill as one example of the present invention, a hammer drill 1 comprises an outer housing 2 and components housed therein which includes a rotation and impact unit 3 disposed in an upper space of the outer housing 2 and a motor 8 disposed in a rear lower space of the rotation and impact unit 3, wherein the rotation and impact unit 3 has a tool holder 7 protruding frontward (leftward in the drawing), and the motor 8 has an output shaft 9 thereof oriented upward. The rotation and impact unit 3 is covered by a holder housing 4 in which the tool holder 7 is rotatably supported, a crank housing 5 which is disposed rearward of and coupled to the holder housing 4, and a gear housing 6 which is disposed below and coupled to the crank housing 5, and defined within the outer housing 2. The output shaft 9 of the motor 8 is rotatably supported by a ball bearing 10 held at the bottom of the gear housing 6 and is inserted into the rotation and impact unit 3.

The tool holder 7 has a front end configured to be able to hold a bit 11 fitted and installed therein, and incorporates an impact bolt 12 as an interjacent element which is disposed rearward of the bit 11 and configured to be movable frontward and rearward in a predetermined stroke. A receiving ring 14 for receiving the rear end of a large-diametered portion of the impact bolt 12 and an elastic ring 15 into which a shaft portion 13 at a rear of the impact bolt 12 is loosely inserted are accommodated in the tool holder 7 at positions rearward of the impact bolt 12 in such a manner that they are movable frontward and rearward along the axial direction of the impact bolt 12.

In the tool holder 7, a cylinder 16 held by the crank housing 5 is loosely and coaxially inserted from rearward of the tool holder 7; inside the cylinder 16, a striker 17 as an impactor disposed frontward and a piston 19 disposed rearward of the striker 17 with an air chamber 18 interposed therebetween are housed, in a manner that renders them movable frontward and rearward, respectively, so that an impact mechanism is formed. The piston 19 is connected via a connecting rod 20 to an eccentric pin 22 provided protrusively on an upper surface of the crank shaft 21. The crank shaft 21 is disposed rearward of the output shaft 9 and is rotatably supported in a position parallel to the output shaft 9. A gear 23 provided at a lower portion of the crank shaft 21 is in mesh with a pinion of the output shaft 9. In this way, the crank mechanism comprised of the connecting rod 20 and the crank shaft 21 can convert a rotary motion of the output shaft 9 to a reciprocating motion of the piston 19.

Further, a slide tube 24 is fitted onto a front part of the cylinder 16. At the front end of the slide tube 24, there is provided a stopper portion 25 which comes to a stop against the front end of the cylinder 16. The slide tube 24 is configured to be movable frontward and rearward between a retreating position where the stopper portion 25 is brought into contact with and stops against the front end of the cylinder 16 and an advancing position as shown in FIG. 1 where the stopper portion 25 comes into contact with the elastic ring 15 when the elastic ring 15 moves forward together with the receiving ring 14 until the receiving ring 14 comes into contact with a stepped portion 26 of the tool holder 7. A second slide tube 27 is fitted onto the cylinder 16 continuously at a rearward of the slide tube 24. Meanwhile, a sleeve-shaped bevel gear 30 configured to rotate integrally with the tool holder 7 by the engagement of engagement nails 28, 29 is fitted onto a rear end of the tool holder 7, and the slide tube 24 and the second slide tube 27 are urged toward the frontward direction by means of a coil spring 32 that is arranged between a protrusion 31 protruding from an inner periphery of the bevel gear 30 in the proximity of an outer periphery of the cylinder 16 and the second slide tube 27. Denoted by reference numerals 33, 33 are air holes formed in the air chamber 18 within the cylinder 16. The air holes 33, 33 are closed by the second slide tube 27 when the slide tube 24 and the second slide tube 27 are positioned at their retreating positions by the insertion of the bit 11 into the tool holder 7, so that the air chamber 18 provides an air spring action. On the contrary, under an unloaded state where the bit 11 is not attached to the tool holder 7, the slide tube 24 and the second slide tube 27 move forward to release the air holes 33, so that the air chamber 18 is in communication with an outside of the cylinder 16 and the air spring action is lost to prevent a blank shot.

A reduction shaft 34 is disposed below the cylinder 16 and frontward of the output shaft 9, and is rotatably supported in a position parallel to the output shaft 9. An upper end portion of the reduction shaft 34 is rotatably supported by a ball bearing 35 retained in the crank housing 5, while a lower end portion of the reduction shaft 34 is rotatably supported by a bearing sleeve 36 retained in the gear housing 6. A bevel gear 37 is provided at an upper end of the reduction shaft 34, and the bevel gear 37 is in mesh with a bevel gear 30 at the tool holder 7 side. Further, a driven gear 38 is provided at an intermediate part of the reduction shaft 34, and the driven gear 38 is in mesh with the pinion of the output shaft 9.

It is however to be noted that the driven gear 38 is fitted on the reduction shaft 34 and is configured to be rotatable separately from the reduction shaft 34. A clutch mechanism is arranged between the driven gear 38 and the reduction shaft 34 so that a connection and a disconnection of the transmission of the rotary motion from the driven gear 38 to the reduction shaft 34 can be switched. As seen in FIG. 2, the clutch mechanism comprises a clutch pin 40 configured to be slidable within a through-hole 39 formed in the shaft center of the reduction shaft 34, and two balls 41, 41 disposed around the reduction shaft 34 and configured to move outward toward or inward from the driven gear 38 in accordance with sliding positions of the clutch pin 40.

The clutch pin 40 is a shaft member having an enlarged diametered pressing portion 42 at slightly above the intermediate portion thereof, and the pressing portion 42 is slidably movable within the through-hole 39. At a sliding position where the pressing portion 42 interferes with the balls 41, 41, the balls 41, 41 in a state being on the pressing portion 42 protrude outside the outer surface of the reduction shaft 34 and come into engagement with engageable recesses 43, 43 formed in an inner surface of the driven gear 38. Therefore, the reduction shaft 34 and the driven gear 38 are coupled together in the rotational direction through the balls 41. However, at a sliding position where the pressing portion 42 does not interfere with the balls 41, 41, the balls 41, 41 are allowed to move into the reduction shaft 34, so that when the driven gear 38 rotates, the balls 41, 41 are away from the engageable recesses 43, 43 and the connection between the reduction shaft 34 and the driven gear 38 is disconnected. Recess-shaped tapered guide portions 44, 44 for smoothly guiding the balls 41 onto the pressing portion 42 are provided on an upper surface and a lower surface of the pressing portion 42.

Further, the clutch pin 40 is configured such that when it is slid upward, an upper end of the clutch pin 40 can protrude from the reduction shaft 34 in a state that the pressing portion 42 does not interfere with the balls 41. As seen in FIG. 3, an engagement ring 45 is fitted onto the cylinder 16 at above the clutch pin 40. The engagement ring 45 has a plurality of engagement holes 46, 46 . . . as an engagement portion, which are equiangularly provided along a circumferential direction of the engagement ring 45 and into which the protruding upper end of the clutch pin 40 can be inserted. The engagement ring 45 is rotatable separately from the cylinder 16. The engagement ring 45 has an engagement gear 47 at a front end thereof, and the engagement gear 47 is in mesh with an engagement gear 48 provided on an inner periphery of the bevel gear 30, so that the engagement ring 45 is coupled with and rotatable integrally with the tool holder 7 through the bevel gear 30. Therefore, when the upper end of the clutch pin 40 protrudes from the reduction shaft 34 and is inserted into one of the engagement holes 46 of the engagement ring 45, the rotation of the tool holder 7 is locked through the engagement ring 45 and the bevel gear 30.

Further, a coil spring 51 as an urging member is positioned between a stopper ring 49 which is retained in the through-hole 39 and a stopper ring 50 which is retained at a lower part of the clutch pin 40, so that the clutch pin 40 is urged downward with the lower end thereof protruding from the gear housing 6. The lower end of the clutch pin 40 contacts with an L-shaped clutch operating lever 52 as a rocking member, which is provided in the outer housing 2 and positioned below the clutch pin 40.

As seen in FIG. 4, the clutch operating lever 52 comprises a first lever 55 which is supported on a pair of right and left supporting plates 53, 53 extending downward from the lower surface of the gear housing 6, and a second lever 56 which is assembled with the first lever in such a manner as to be rotatable with respect to the first lever 55. The first lever 55 is formed as an inverted U-shaped plate member 57 with both ends thereof bent downward, and a connecting strip 58 is provided protrusively on an upper surface of the plate member 57. Circular projections 59, 59 are formed on the right and left ends of the U-shaped plate member 57 in a penetrating manner, and outer ends of the circular projections 59, 59 are fitted into corresponding through-holes 54, 54 formed in the lower ends of the supporting plates 53, 53, so that the first lever 55 is supported on the supporting plates 53, 53 so as to be rotatable around the circular projections 59, 59. The second lever 56 has a shaft member 60 positioned below the plate member 57 of the first lever 55, and circular recesses 61, 61 are formed in right and left end surfaces of the shaft member 60. Inner ends of the circular projections 59, 59 of the plate member 57 are fitted into the circular recesses 61, 61 of the second lever 56, so that the second lever 56 is supported on the first lever 55 so as to be rotatable around the circular projections 59, 59. Further, a contacting plate 62 having a width smaller than that of the lower surface of the plate member 57 of the first lever 55 and extending rearward beyond the plate member 57 is provided continuously from the shaft member 60, and the lower end of the clutch pin 40 is brought into contact with a rear center part of the contacting plate 62.

Denoted by reference numerals 63, 64 are a first torsion spring and a second torsion spring. The first torsion spring 63 is wound around one end side of the shaft member 60 of the second lever 56 so that ends of the first torsion spring 63 are engaged with the first lever 55 and the second lever 56, respectively, to thereby urge the first and second levers 55, 56 to an approaching direction toward each other. The second torsion spring 64 is wound around the other end side of the shaft member 60 of the second lever 56 so that ends of the second torsion spring 64 are engaged with the first lever 55 and a rib 53*a* extending from one of the supporting plates 53, 53, respectively, to thereby urge the first lever 55 in a clockwise rotation direction of FIG. 1. In a normal state, the plate member 57 of the first lever 55 and the contacting plate 62 of the second lever 56 are urged by the first torsion spring 63 to such a position where they are overlapped one another as shown in FIG. 1.

A wire 65 is connected to the first lever 55 at the upper end of the connecting strip 58. The wire 65 extends through a tube 66, both ends of which are fixed within the outer housing 2, and is connected to an operating member 67 rotatably provided on an upper surface of the outer housing 2. When a pulling amount of the wire 65 is changed by a rotating operation of the operating member 67, rocking positions of the clutch operating lever 52 around the circular projections 59 can be changed.

In the hammer drill 1 configured as described above, when the bit 11 is installed and held in the tool holder 7, the impact bolt 12 pressed by the bit 11 retreats, causing the slide tube 24 and the second slide tube 27 to slide back to their retreating positions through the receiving ring 14 and the elastic ring 15.

Thereafter, when the pulling amount of the wire 65 is changed to the minimum amount using the operating member 67, the clutch operating lever 52 is rocked by means of the second torsion spring 64 to a clockwise rotation direction for the maximum amount, and as seen in FIG. 5 (A) (wherein the contacting plate 62 is illustrated only with a front end part thereof to which the clutch pin 40 contacts), the clutch pin 40 that is urged downward is caused to protrude to a lower limit position where the stopper ring 50 comes into contact with a ring-shaped stopper 68 at the lower end of the reduction shaft 34. In this lower limit position, the pressing portion 42 interferes with the balls 41, 41 and urges the balls 41, 41 outward, so that the driven gear 38 and the reduction shaft 34 are coupled together, which is a so-called hammer drill mode.

In this condition, when a switch lever (not shown) provided at the outer housing 2 is manipulated to activate the motor 8, the rotary motion of the output shaft 9 is transmitted to the crank shaft 21, and the rotary motion of the crank shaft 21 is converted into the reciprocating motion of the piston 19 actuated via the connecting rod 20. Since the air holes 33 of the air chamber 18 are closed by the second slide tube 27, the air chamber 18 provides an air spring action, and the striker 17 is moved in synchronization with the reciprocating motion of the piston 19 and pushed by the rear end of the bit 11 so as to strike the shaft portion 13 of the impact bolt 12 protruded into the cylinder 16. In this way, the striking motion by the striker 17 is imparted indirectly to the bit 11.

At the same time, the rotary motion of the output shaft 9 is transmitted to the driven gear 38 to rotate the reduction shaft 34. Therefore, the rotation of the reduction shaft 34 is transmitted to the tool holder 7 through the bevel gears 37, 30. Accordingly, the tool holder 7 rotates, so that the bit 11 rotates as well as performs a striking motion.

Next, when the pulling amount of the wire 65 is changed to an intermediate amount using the operating member 67, the clutch operating lever 52 is rocked to a counterclockwise rotation direction, and as seen in FIG. 5 (B), the contacting plate 62 lifts up the clutch pin 40 against the urging force of the coil spring 51. In this intermediate position, the pressing portion 42 is kept away from the balls 41, 41 to release a pressing motion of the balls 41, 41, and the upper end of the clutch pin 40 does not protrude from the reduction shaft 34, which is a so-called hammer mode (neutral state).

When the motor 8 is activated in this condition, the crank mechanism operates in a similar manner as above in the hammer drill mode. However, the rotation of the driven gear 38 is not transmitted to the reduction shaft 34 because of the clutch mechanism, so that the tool holder 7 does not make a rotary motion and the striking motion only is imparted to the bit 11. At this time, since the reduction shaft 34 and the tool holder 7 are kept in a rotation free state, the angle around the axis of the bit 11 can be changed arbitrarily.

Further, when the pulling amount of the wire 65 is changed to the maximum amount using the operating member 67, the clutch operating lever 52 is rocked further to the counterclockwise rotation direction, and as seen in FIG. 5 (C), the contacting plate 62 lifts up the clutch pin 40 to an upper limit position where the upper end of the clutch pin 40 is caused to protrude from the reduction shaft 34. In this upper limit position, the pressing portion 42 remains kept away from the balls 41, 41 to release the pressing motion of the balls 41, 41, but the upper end of the clutch pin 40 is inserted into an engagement hole 46 of the engagement ring 45, which is a so-called hammer mode (rotation locked state).

When the motor 8 is activated in this condition, the crank mechanism operates in a similar manner as above in the hammer drill mode. However, the rotation of the driven gear 38 is not transmitted to the reduction shaft 34 because of the clutch mechanism, so that the tool holder 7 does not make a rotary motion and the striking motion only is imparted to the bit 11. It is to be noted that since the upper end of the clutch pin 40 is inserted into the engagement hole 46 of the engagement ring 45, the rotation of the tool holder 7 and the bit 11 is locked.

When the clutch pin 40 is moved to the upper limit position, unless an engagement hole 46 of the engagement ring 45 is positioned exactly right above the clutch pin 40, the clutch pin 40 contacts with the peripheral surface of the engagement ring 45 and the upward movement of the clutch pin 40 is prevented. However, in this instance, since the second lever 56 does not follow the rocking motion of the first lever 55 in the counterclockwise rotation direction and only the first lever 55 is rocked (because the plate member 57 and the contacting plate 62 are away from each other) while the contacting plate 62 moves away from the plate member 57 against the urging force of the first torsion spring 63, it is possible to absorb a load applied to the clutch operating lever 52 when the upward movement of the clutch pin 40 is prevented. When the tool holder 7 is rotated using the bit 11 to position one of the engagement holes 46 exactly right above the clutch pin 40, the second lever 56 rotates counterclockwise because of the urging force of the first torsion spring 63, so that the contacting plate 62 returns to the contacting position with the plate member 57 and the upper end of the clutch pin 40 is inserted into the engagement hole 46.

Thus, according to the hammer drill 1 configured as described above, the clutch pin 40 is provided in the reduction shaft 34 so as to be slidable by an operation from outside the outer housing 2, and the driven gear 38 is fitted onto the reduction shaft 34 and configured to be rotatable separately from the reduction shaft 34 so as to provide a clutch mechanism, and by a switching operation of the clutch mechanism, a selection can be made between the hammer drill mode and the hammer mode. Meanwhile, the clutch pin 40 is configured to be slidable to a sliding position where the clutch pin 40 runs through the reduction shaft 34 so as to be capable of protruding upward beyond the reduction shaft 34, and at this sliding position, the clutch pin 40 engages with one of the engagement holes 46 provided on the tool holder 7 side so that the rotation of the tool holder 7 can be locked, whereby in the hammer mode, a selection can be further made between the neutral state where the clutch pin 40 does not engage with any one of the engagement holes 46 and the rotation locked state where the clutch pin 40 engages with one of the engagement holes 46. Therefore, in the hammer mode, the upper end of the clutch pin 40 is directly engaged with or disengaged from the tool holder 7 side without rotating the clutch pin 40 so that the neutral state and the rotation locked state can be selected. Therefore, the clutch pin 40 is less likely to subject to wear or breakage, so that better durability is achieved. Further, the mode switching is performed by sliding the clutch pin 40 in a relative short stroke length, so that the whole size of the hammer drill 1 as well as the size of the reduction shaft 34 can be reduced.

Especially, the clutch mechanism comprises balls 41 provided in the reduction shaft 34 so as to be movable in the radial direction of the reduction shaft 34, and the pressing portion 42 provided at the clutch pin 40, wherein the pressing portion 42 presses the balls 41 toward outside of the reduction shaft 34 so that the balls 41 are interposed between the reduction shaft 34 and the driven gear 38 so as to engage the reduction shaft 34 and the driven gear 38 when the clutch pin 40 is positioned in a sliding position in the hammer drill mode, and the pressing portion 42 releases the pressing motion of the balls 41 to disengage the engagement between the driven gear 38 and the reduction shaft 34 when the clutch pin 40 is positioned in other sliding positions in the other mode. Therefore, a highly durable and simple clutch mechanism utilizing the clutch pin 40 can be provided.

The clutch pin 40 is configured to be slidable to a sliding position where the clutch pin 40 runs through the reduction shaft 34 so as to be capable of protruding downward beyond the reduction shaft 34, and the coil spring 51 for urging the clutch pin 40 toward the protruding direction is provided. Further, the clutch operating lever 52 to which the clutch pin 40 at the protruding position contacts is provided in the outer housing 2 at a position below the clutch pin 40, and the clutch operating lever 52 is connected by wire 65 to the operating member 67 provided at the external surface of the outer housing 2, so that the sliding positions of the clutch pin 40 can be changed when the clutch operating lever 52 is rocked through the wire 65 by the operation of the operating member 67.

Accordingly, the rocking operation of the clutch operating lever 52 can be simply and reliably performed.

In the above-described embodiment, the engagement ring is provided with engagement holes into which the upper end of the clutch pin is inserted, but recesses may be formed in the engagement ring instead. Further, the engagement ring may be omitted, and the clutch pin may be engaged with the bevel gear. As an alternative, the clutch pin may be engaged with recesses formed along the peripheral surface of the tool holder.

Further, in place of the balls, the clutch mechanism may comprise other coupling members such as rollers. The urging member for urging the clutch pin may comprise other means such as a plate spring and a tension spring.

On the other hand, the clutch operating lever as a rocking member may consist of a single L-shaped lever, instead of using two levers as described in the above embodiment. Of course, the manner of operation of the rocking member is not limited to the one using the wire, and other linkage structures such as a link mechanism may be employed. As an alternative, without such a linkage structure, the rocking member may be directly operated using an operating member provided outside the housing. For this reason, other than on the upper surface of the housing, the operating member may be provided on a rear surface or a side surface of the housing.

Furthermore, two slide tubes are used in the hammer drill according to the above embodiment, and the air holes are closed by the second slide tube. However, the air holes may be closed by a single slide tube, in which the second slide tube is integrally formed with the first slide tube. Of course, the present invention is applicable to other types; for example, a type in which a catcher is provided in front of the impactor without employing slide tubes and the catcher holds the impactor to prevent a blank shot, a type in which the impactor directly strikes the rear end of the bit without employing an interjacent element, a type in which another reduction shaft is interposed between the reduction shaft and an intermediate shaft, and a type in which a torque limiter is provided in the driven gear at the reduction shaft.

EXPLANATION OF REFERENCE NUMERALS

Figure 1:
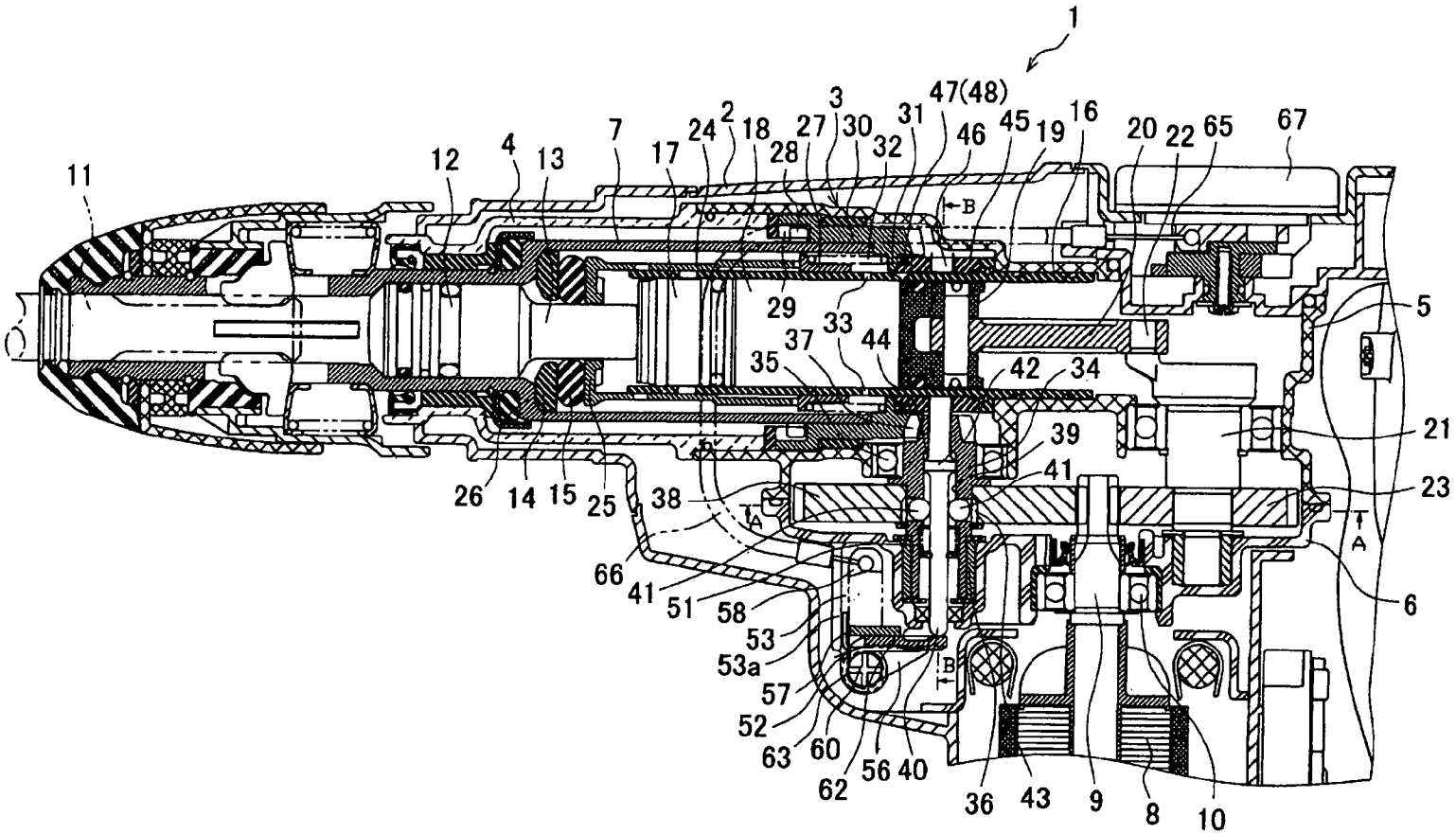
FIG. 1 is a partially illustrated vertical section of a hammer drill.
Figure 2:
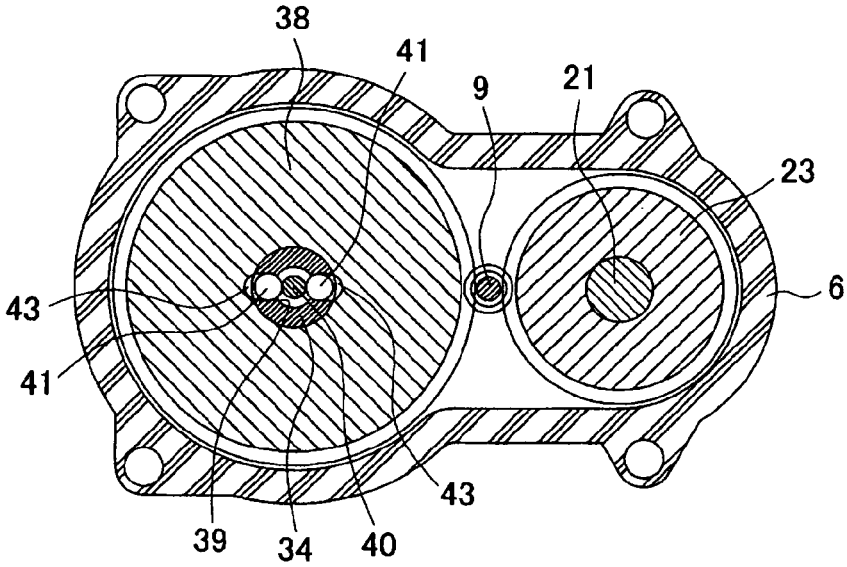
FIG. 2 is a sectional view taken along the line A-A.
Figure 3:
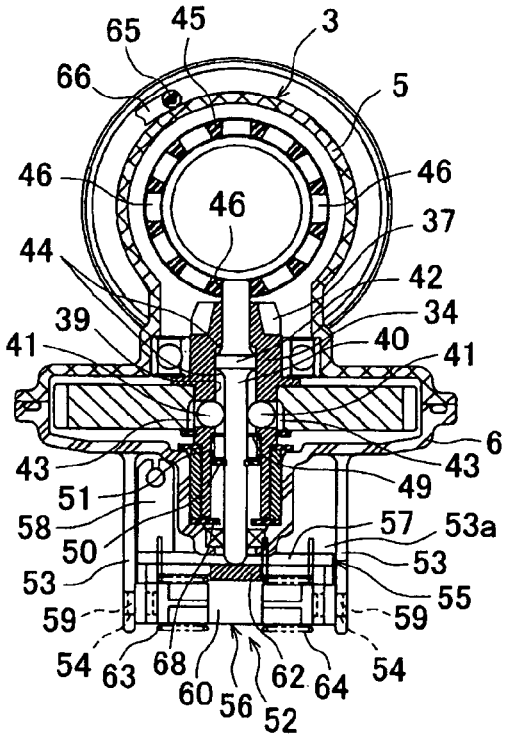
FIG. 3 is a sectional view taken along the line B-B.
Figure 4:
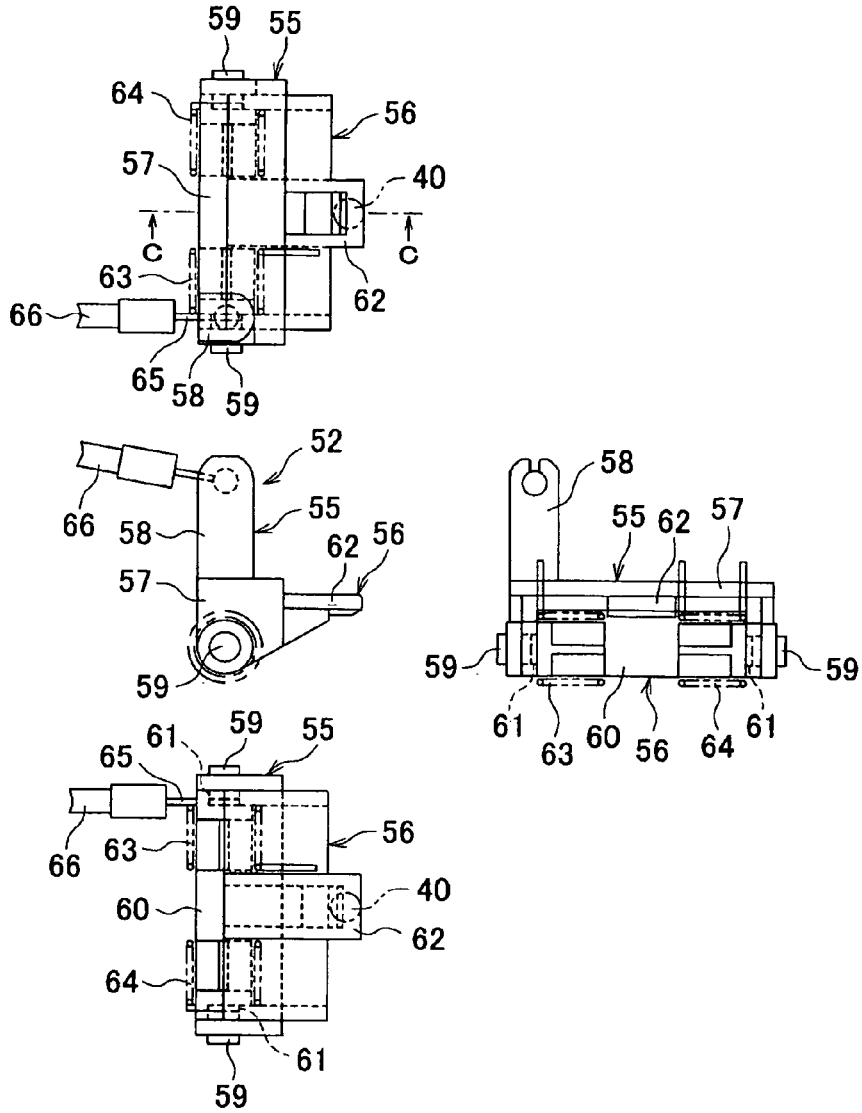
FIG. 4 is explanatory views of a clutch operating lever, in which (A) shows a top view at the top side, a front view at the middle side, a right-side view at the right-hand side, and a bottom view at the bottom side, respectively, and (B) is a sectional view taken along the line C-C.
Figure 4:
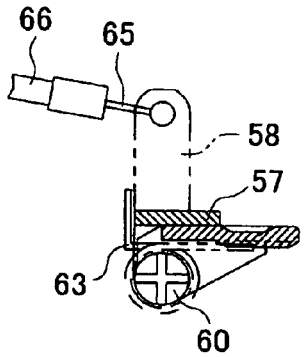
Figure 5:
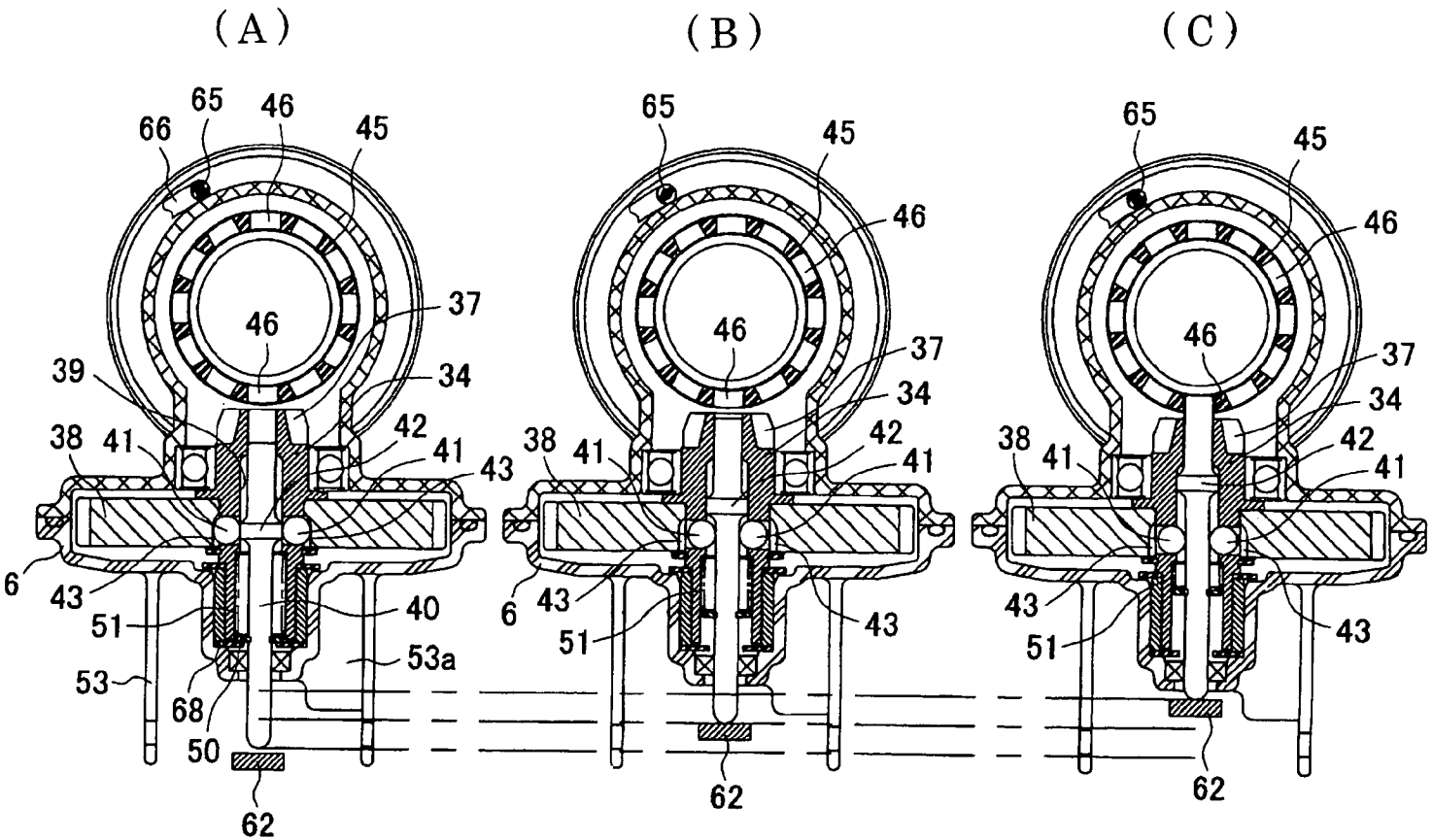
FIG. 5 is explanatory views of mode switching, in which (A) shows a hammer drill mode, (B) shows a hammer mode (neutral state), and (C) shows a hammer mode (rotation locked state).

1—HAMMER DRILL,
2—OUTER HOUSING,
3—ROTATION AND IMPACT UNIT,
4—HOLDER HOUSING,
5—CRANK HOUSING,
6—GEAR HOUSING,
7—TOOL HOLDER,
8—MOTOR,
9—OUTPUT SHAFT,
11—BIT,
12—IMPACT BOLT,
16—CYLINDER,
17—STRIKER,
18—AIR CHAMBER,
19—PISTON,
21—CRANK SHAFT,
24—SLIDE TUBE,
30, 37—BEVEL GEAR,
34—REDUCTION SHAFT,
38—DRIVEN GEAR,
40—CLUTCH PIN,
41—BALL,
42—PRESSING PORTION,
43—ENGAGEABLE RECESS,
45—ENGAGEMENT RING,
46—ENGAGEMENT HOLE,
52—CLUTCH OPERATING LEVER,
55—FIRST LEVER,
56—SECOND LEVER,
65—WIRE,
67—OPERATING MEMBER.

The invention claimed is:

1. A hammer drill comprising:

a tool holder provided in a housing and configured to be rotatable with a bit being attached to a front end of the tool holder;

a motor having an output shaft, the motor being disposed rearward of the tool holder with the output shaft oriented in a direction perpendicular to an axis of the tool holder;

an impact mechanism provided in the housing and configured to strike the bid according to a rotation of the output shaft;

a reduction shaft disposed in a position parallel to the output shaft between the output shaft and the tool holder, the reduction shaft comprising a driven gear and a bevel gear, the driven gear being configured to mesh with the output shaft, and the bevel gear being configured to couple with the tool holder, so that a rotary motion of the output shaft is transmitted to the tool holder;

a clutch pin provided in the reduction shaft and slidable along an axis of the reduction shaft, the clutch pin being configured to be slidable by an operation from outside the housing; and a clutch mechanism configured to select between a hammer drill mode where the driven gear is caused to engage with the reduction shaft so that a rotary motion is transmitted to the tool holder and a hammer mode where the driven gear and the reduction gear are disengaged from each other so that the rotary motion transmitted to the tool holder is interrupted, the driven gear being configured to be rotatable separately from the reduction shaft, and the engagement between the driven gear and the reduction shaft and the disengagement between the driven gear and the reduction shaft being switchable in accordance with sliding positions of the clutch pin;

wherein the clutch pin is configured to be slidable to a sliding position where the clutch pin runs through the reduction shaft so as to be capable of protruding upward beyond the reduction shaft, and at the sliding position, the clutch pin engages with an engagement portion provided on the tool holder side so that a rotation of the tool holder can be locked, whereby in the hammer mode, a selection can be further made between a neutral state where the clutch pin does not engage with the engagement portion to allow free rotation of the tool holder and a rotation locked state where the clutch pin engages with the engagement portion to lock the rotation of the tool holder.

2. The hammer drill according to claim 1, wherein the clutch mechanism comprises at least one ball provided in the reduction shaft so as to be movable in a radial direction of the reduction shaft, and a pressing portion provided at the clutch pin, the pressing portion pressing the ball toward outside of the reduction shaft so that the ball is interposed between the reduction shaft and the driven gear so as to engage the reduction shaft and the driven gear when the clutch pin is positioned in a sliding position in the hammer drill mode, and the pressing portion releasing a pressing motion of the ball to disengage the engagement between the driven gear and the reduction shaft when the clutch pin is positioned in other sliding positions in the other mode.

3. The hammer drill according to claim 2, wherein the at least one ball comprises two balls which are symmetrical about a shaft center of the reduction shaft, and wherein in the hammer drill mode, the balls are brought into engagement with engageable recesses formed in an inner surface of the driven gear to connect the reduction shaft and the driven gear.

4. The hammer drill according to claim 3, wherein the pressing portion has a diameter larger than remaining shaft parts of the clutch pin, and wherein a recess-shaped tapered guide portion for guiding the at least one ball onto the pressing portion is provided on an upper surface and a lower surface of the pressing portion.

5. The hammer drill according to claim 2, wherein the pressing portion has a diameter larger than remaining shaft parts of the clutch pin, and wherein a recess-shaped tapered guide portion for guiding the at least one ball onto the pressing portion is provided on an upper surface and a lower surface of the pressing portion.

6. The hammer drill according to claim 2, wherein the clutch pin is configured to be slidable to a sliding position where the clutch pin runs through the reduction shaft so as to be capable of protruding downward beyond the reduction shaft, and an urging member for urging the clutch pin toward the protruding direction is provided, and wherein a rocking member to which the clutch pin at the protruding position contacts is provided in the housing at a position below the clutch pin, and the rocking member is connected by wire to an operating member provided at an external surface of the housing, so that the sliding positions of the clutch pin can be changed when the rocking member is rocked through the wire by an operation of the operating member.

7. The hammer drill according to claim 1, wherein a cylinder configured to accommodate the impact mechanism and to be inserted into the tool holder from rearward of and coaxially with the tool holder is provided in the housing, wherein an engagement ring is provided on the cylinder at above the clutch pin so as to be rotatable separately from the cylinder, the engagement ring having an engagement gear at a front end thereof and the engagement gear being meshed with a bevel gear integrally formed on the tool holder, and wherein the engagement portion is a plurality of engagement holes equiangularly provided along a circumferential direction of the engagement ring, into which an upper end of the clutch pin can be inserted.

8. The hammer drill according to claim 7, wherein the impact mechanism comprises a piston accommodated in the cylinder and configured to reciprocate in a forward and rearward direction in the cylinder when the motor is actuated, and an impactor accommodated in the cylinder at a position forward of the piston with an air chamber interposed therebetween and configured to reciprocate in a forward and rearward direction in the cylinder.

9. The hammer drill according to claim 8, wherein a slide tube is provided at a front part of the cylinder, the slide tube being configured to reciprocate in a forward and rearward direction along an axial direction of the cylinder and to be urged toward a frontward direction by a coil spring, and wherein the air chamber is provided with an air hole which is closed by the slide tube when the slide tube is positioned at a retreating position.

10. The hammer drill according to claim 8, wherein a crank shaft, to which the rotary motion of the output shaft is transmitted, is disposed rearward of the output shaft of the motor in a position parallel to the output shaft, and wherein the piston is connected via a connecting rod to an eccentric pin provided protrusively on an upper surface of the crank shaft.

11. The hammer drill according to claim 1, wherein the clutch pin is configured to be slidable to a sliding position where the clutch pin runs through the reduction shaft so as to be capable of protruding downward beyond the reduction shaft, and an urging member for urging the clutch pin toward the protruding direction is provided, and wherein a rocking member to which the clutch pin at the protruding position contacts is provided in the housing at a position below the clutch pin, and the rocking member is connected by wire to an operating member provided at an external surface of the housing, so that the sliding positions of the clutch pin can be changed when the rocking member is rocked through the wire by an operation of the operating member.

12. The hammer drill according to claim 11, wherein the rocking member is rotatable in the housing with an upper end of the rocking member being connected to the wire, and wherein the rocking member is formed as an L-shaped clutch operating lever having a contacting plate protruding rearward from a rotation shaft, and the clutch pin is brought into contact with the contacting plate.

13. The hammer drill according to claim 12, wherein the clutch operating lever comprises a first lever to which the wire is connected and rotatably supported in the housing, and a second lever assembled with the first lever in such a manner as to be rotatable with respect to the first lever and having the contacting plate, and wherein a first torsion spring is provided between the first lever and the second lever to retain both the first and second levers in an L-shaped posture of the clutch operating lever.

14. The hammer drill according to claim 13, wherein a second torsion spring is provided between the housing and the first lever so as to urge the clutch operating lever toward a rotating direction, in which the contacting plate is away from the clutch pin in a downward direction.

15. The hammer drill according to claim 12, wherein the operating member is rotatably provided on the housing and is configured to change a pulling amount of the wire by a rotating operation thereof so as to rock the clutch operating lever.

* * * * *